US005789866A

United States Patent [19]

Keith et al.

[11] Patent Number: 5,789,866

[45] Date of Patent: Aug. 4, 1998

[54] ELECTRONIC BALLAST WITH REVERSELY WOUND FILAMENT WINDING

[75] Inventors: William L. Keith, Algonquin; Patrick J. Keegan, Schaumburg; Bruce R. Rhodes, Inverness, all of Ill.

[73] Assignee: Energy Savings, Inc., Schaumburg, Ill.

[21] Appl. No.: 893,741

[22] Filed: Jul. 11, 1997

[51] Int. Cl.[6] ..... H05B 37/00

[52] U.S. Cl. ..... 315/105; 315/209 R; 315/DIG. 5

[58] Field of Search ..... 315/224, 209 R, 315/DIG. 2, DIG. 5, 291, 94, 105

[56] References Cited

U.S. PATENT DOCUMENTS 4,158,792 6/1979 Kuroi et al. ..... 315/DIG. 5

*Primary Examiner*—Benny T. Lee
*Assistant Examiner*—David H. Vu
*Attorney, Agent, or Firm*—Paul F. Wille

[57] ABSTRACT

An electronic ballast includes a series resonant inductor and capacitor and a filament winding magnetically coupled to said inductor. The filament winding forms a closed circuit with a filament in a gas discharge lamp, wherein the current induced in the winding opposes a portion of the current through the inductor to reduce the net voltage on the filament during normal lamp operation. In accordance with another aspect of the invention, the filament winding is reversely wound with the inductor on a common core to reverse the phase of the current induced in the filament winding from the current through the inductor.

6 Claims, 1 Drawing Sheet

ELECTRONIC BALLAST WITH REVERSELY WOUND FILAMENT WINDING

BACKGROUND OF THE INVENTION

This invention relates to an electronic ballast for a gas discharge lamp and, in particular, to the portion of the ballast supplying power to the filaments in a gas discharge lamp.

A gas discharge lamp is a non-linear electrical load, i.e. the current through the lamp is not proportional to the voltage across the lamp. The current is zero until the voltage increases sufficiently for an arc to strike, then the current will increase rapidly through the ionized gases in the lamp unless there is a ballast in series with the lamp to limit current.

In many gas discharge lamps, small filaments at each end of the lamp are made to glow and emit electrons to facilitate starting the lamp. The filaments are typically coated with a material having a low work function, that is, a material that emits electrons profusely when heated, thereby aiding in ionizing the gases within the lamp and reducing the voltage required to start the lamp.

A "magnetic" ballast is an inductor in series with a lamp for limiting current through the lamp. The inductor includes many turns of wire wound on a laminated iron core and magnetic ballasts of the prior art are physically large and heavy, often accounting for more than half the weight of a fixture including the lamps.

An "electronic" ballast typically includes a converter for changing the AC from a power line to direct current (DC) and an inverter for changing the DC to high frequency AC. Converting from AC to DC is usually done with a full wave, or bridge, rectifier. A filter capacitor on the output of the rectifier stores energy for powering the inverter. The inverter changes the DC to high frequency AC at 140–300 volts for powering one or more gas discharge lamps.

It is known in the art to provide an electronic ballast having a "direct coupled" output, in which a lamp is connected in parallel with the capacitor in a series resonant LC circuit. Separate windings, magnetically coupled to the resonant inductor, provide current for heating the filaments in a lamp. Thus, the filaments are powered continuously, reducing the efficiency of the lamp, measured in lumens per watt.

The windings are made by winding the resonant inductor on a suitable core, tying off a common lead, and then winding one of the filament windings. A second filament winding, or second and third filament windings for a two lamp system, are then wound on the core. The magnetics, i.e. the inductors and transformers, are one of the more expensive components in an electronic ballast. Winding a filament winding having a common lead with the resonant inductor is less expensive than a magnetic with separate windings for the resonant inductor and a filament.

Many modern, high efficiency lamps, such as T2, T5, and some compact lamps require a relatively low filament voltage during normal operation for reduced temperature and long life. For example, a T2 lamp is usually specified as having a maximum filament voltage of three volts during normal operation. Unfortunately, it is also required that the filaments be red-hot during the pre-heat phase of lamp starting. Adequately heating the filaments for starting requires six to eight volts, substantially in excess of the three volt limit imposed during running. Some manufacturers specify a limit on the total current through a filament, which is the equivalent of a limit on voltage. Thus, the problem is to provide adequate voltage for starting and low voltage for running.

In a ballast having a direct coupled output, the starting phase and the running phase of lamp operation are distinguished by a change in frequency. As more fully described in the Detailed Description, a ballast having a direct coupled output is typically started at a frequency well above resonance, causing a relatively high voltage to be applied to the filaments and a relatively low voltage to be applied to the lamp, and is run at a frequency slightly above loaded resonance, causing a high voltage to be applied to the lamp and a relatively low voltage to be applied to the filaments. Even so, the filament voltage during normal operation is typically greater than three volts in ballasts of the prior art.

One could use electronic switches to control the voltage on the filaments but this would substantially increase the cost of a ballast and is, therefore, undesirable.

In view of the foregoing, it is therefore an object of the invention to reduce filament voltage during normal operation of a gas discharge lamp without impairing starting.

A further object of the invention is to improve the efficiency of an electronic ballast.

Another object of the invention is to improve the efficiency of an electronic ballast without increasing cost.

SUMMARY OF THE INVENTION

The foregoing objects are achieved in this invention in which an electronic ballast includes a series resonant inductor and capacitor and a filament winding magnetically coupled to said inductor. The filament winding forms a closed circuit with a filament in a gas discharge lamp, wherein the current induced in the winding opposes a portion of the current through the inductor to reduce the net voltage on the filament during normal lamp operation. In accordance with another aspect of the invention, the filament winding is reversely wound with the inductor on a common core to reverse the phase of the current induced in the filament winding from the current through the inductor.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
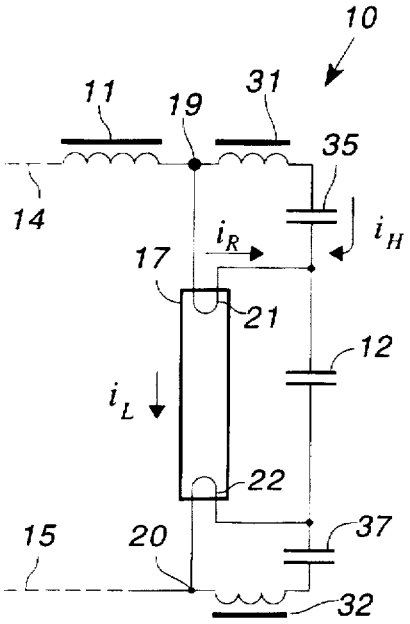
FIG. 1 is a schematic of a single lamp output circuit constructed in accordance with the invention.

FIG. 1 illustrates a preferred embodiment of the invention as applied to a ballast for a single gas discharge lamp. Output 10 is a direct coupled output including resonant inductor 11 and resonant capacitor 12 series connected across lines 14 and 15. Lines 14 and 15 are coupled to a source of pulses (not shown) in which the frequency of the pulses can be varied from approximately equal to the resonant frequency of inductor 11 and capacitor 12 to a frequency substantially higher than the resonant frequency. Circuitry known in the art as a half bridge inverter is but one example of a suitable source of such pulses.

Lamp 17 is connected in parallel with capacitor 12 and filaments 21 and 22 in the lamp are connected in series with capacitor 12. During normal operation, current $i_L$ flows through lamp 17 and current $i_R$ flows through capacitor 12. During starting, only current $i_R$ flows. Nodes 19 and 20 are the output terminals of the ballast illustrated in FIG. 1 and the sum of currents $i_L$ and $i_R$ flows through inductor 11 to node 19.

During starting, filaments 21 and 22 are pre-heated by applying a frequency higher than the resonant frequency of inductor 11 and capacitor 12 to lines 14 and 15. Because the frequency is above resonance, most of the output voltage is across inductor 11 and is coupled to filament windings 31 and 32. Also because of the high frequency, DC blocking capacitors 35 and 37 have a low impedance, allowing maximum coupling to the filaments for heating. The filament windings are each in a small closed circuit through which the heater current flows. Filament windings 31 and 32 are magnetically coupled to resonant inductor 11. Heater current $i_H$ from winding 31 flows through filament 21 and capacitor 35. In accordance with the invention, current $i_R$ is opposed by current $i_H$. During starting, current $i_H$ is considerably greater than current $i_R$ and there is little effect on filament voltage from the slight reduction in net current through filament 21. The same effects occur in the circuit including filament 22.

Once lamp 17 begins conduction, the frequency is reduced to slightly above the loaded resonant frequency of inductor 11 and capacitor 12. As a result, the voltage across capacitor 12 increases considerably and the voltage across inductor 11 is reduced, with a commensurate reduction in the voltages induced in windings 31 and 32. Even so, without the invention, the voltage on filaments 21 and 22 can be excessive. One could reduce the size of resonant capacitor 12 but this increases the resonant frequency and makes the ballast sensitive to stray capacitances.

Because the frequency has been reduced for running, current $i_H$ has decreased, current $i_R$ has increased, and the net current in the filament circuit is lower than during starting. The current induced by windings 31 and 32 does not completely cancel resonant current $i_R$ but merely reduces the net current and, therefore, the RMS voltage across the filaments. In one embodiment of the invention, in a two lamp ballast, the RMS voltage was reduced from 8.1 volts to 5.8 volts.

Figure 2:
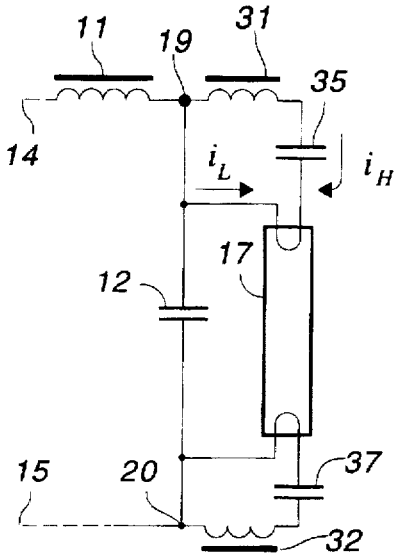
FIG. 2 is an alternative embodiment of an output circuit constructed in accordance with the invention.

FIG. 2 illustrates an alternative arrangement of the components in output 10 (FIG. 1). In particular, resonant capacitor 12 is coupled between nodes 19 and 20. Lamp current $i_L$ is opposed by heater current $i_H$ when lamp 17 conducts. Thus, FIG. 2 differs from FIG. 1 in that the heater current opposes the lamp current instead of opposing the resonant current during normal lamp operation. The filament, the winding, and the blocking capacitor can be connected in several configurations, all of which can benefit from the invention by having the heater current opposes a component of the current from the resonant inductor.

Figure 3:
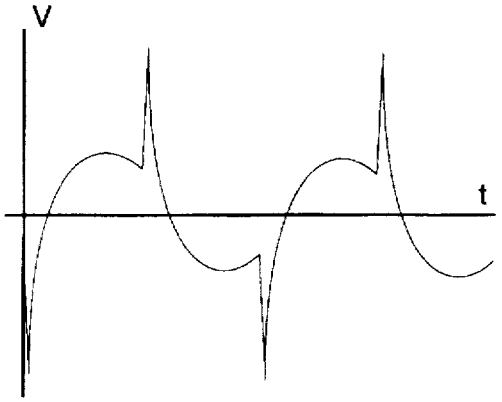
FIG. 3 (PRIOR ART)
FIG. 3 is a chart showing filament voltage in ballasts of the prior art.
Figure 4:
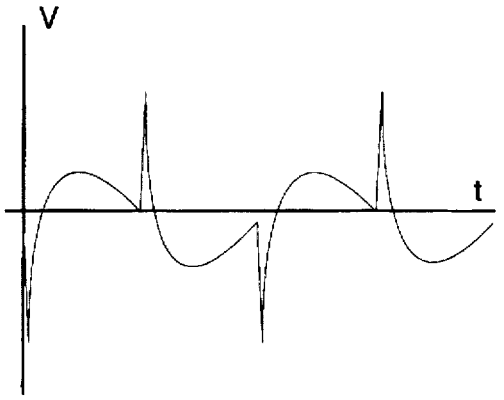
FIG. 4 is a chart showing filament voltage in a ballast constructed in accordance with the invention.

FIG. 3 illustrates the voltage across a filament using a ballast constructed in accordance with the prior art. The current through capacitor 12 (FIG. 1) is sinusoidal but the current from lines 14 and 15 is pulsed, producing the spikes illustrated in FIG. 3. FIG. 4 illustrates the voltage across a filament winding driven by a ballast constructed in accordance with the invention. FIGS. 3 and 4 are drawn to the same scale. Thus, it is clear that the sinusoidal component in FIG. 4 is reduced compared to FIG. 3. The output circuit illustrated in FIG. 1 enables one to provide a filament winding having the correct phase to cause partial cancellation of the current through a filament.

Figure 5:
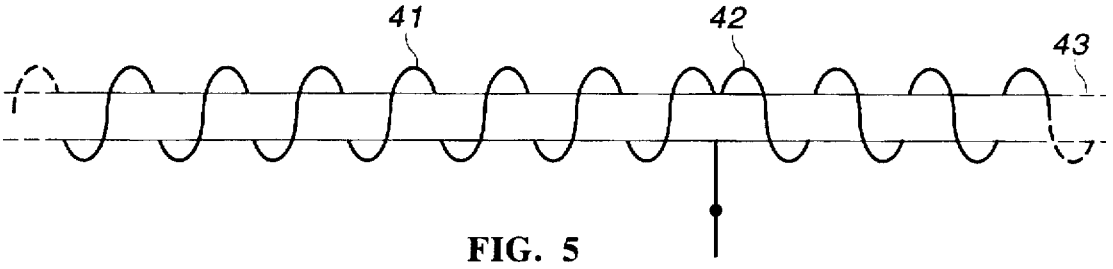
FIG. 5 illustrates winding the resonant inductor and one filament winding on a common core.

In accordance with another aspect of the invention, winding 31 is a reversely wound extension of inductor 11 and is connected to inductor 11 at common node 19. FIG. 5 illustrates the winding of a magnetic in accordance with this aspect of the invention. In particular, winding 41 and winding 42 are wound about common core 43, illustrated in FIG. 5 as a simple bar. It is understood that the magnetics in an electronic ballast are typically wound on an E-shaped core.

Winding 41 encircles core 43 with the turns going in a first direction from the left hand end of core 43 to a point above common node 19. At common node 19, the wire wound around core 43 is brought out away from the core to provide a lead or tap in the windings. Continuing from left to right, the wire continues to be wound around core 43, except that the direction of rotation is changed and winding 42 encircles core 43 by turning in the opposite direction to winding 41. The number of turns in winding 41, a resonant inductor, greatly exceeds the number of turns in winding 42, a filament winding. The voltage induced in winding 42 is of opposite phase to the voltage in winding 41.

Filament winding 32 is a separate winding on a common core with inductor 11 and winding 31. Inductor 32 is connected to filament 22 in such a way that the current from inductor 32 opposes current $i_R$. There are only two ways to connect winding 32 and the winding should be connected for opposing currents.

Figure 6:
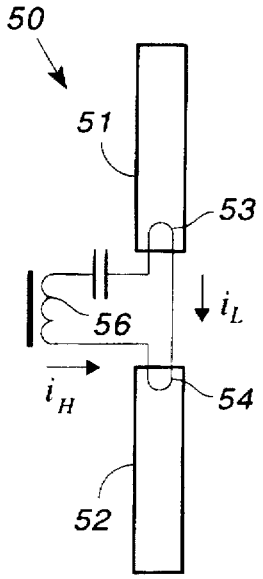
FIG. 6 is a schematic of a two lamp output circuit constructed in accordance with the invention.

Output 50, illustrated in FIG. 6, includes lamps 51 and 52 connected in series across a resonant capacitor (not shown). A filament (not shown) at the upper end of lamp 51 corresponds to filament 21 in FIG. 1. A filament (not shown) at the lower end of lamp 52 corresponds to filament 22 in FIG. 1. At the juncture of lamps 51 and 52, filaments 53 and 54 are series connected across winding 56. Winding 56 is coupled to filaments 53 and 54 in such a way that the current from winding 56 opposes the lamp current through filaments 53 and 54. Thus, the connection of winding 56 is analogous to the connection of filament winding 32 in FIG. 1, except that lamp current rather than resonant current is being opposed.

Thus, the invention provides a no-cost enhancement of an electronic ballast that improves the efficiency of the ballast and enables a ballast to drive T2, T5, and other lamps within the manufacturers specifications for the lamps. In one embodiment of the invention, a two lamp ballast, the invention reduced the power consumed by the ballast by approximately one watt without changing the luminance of the lamp coupled to the ballast.

Having thus described the invention, it will be apparent to those of skill in the art that various modifications can be made within the scope of the invention. For example, the magnetic cores can be E–C, toroidal, or other shapes. The windings in FIG. 5 are exaggerated for illustration. In an actual ballast, the windings are closer together and winding 42 overlays winding 41. Although illustrated in connection with one lamp and two lamp ballasts, the invention applies to ballasts for any number of lamps. The invention also applies to ballasts having a parallel resonant output or a class-E output. The blocking capacitors can be replaced by a direct connection, a diode, or a suitable impedances.

Reference to the direction of a current, as though the output were DC rather than AC, is for ease of understanding.

The phase of an alternating current is the property that is actually being discussed. When two alternating currents are mixed, varying degrees of cancellation or addition may occur, depending upon the relative phases of the currents. If the two currents also differ in waveform, the reduction in voltage on the filaments may not be as great but the filament voltage will be reduced compared to ballasts of the prior art.

What is claimed as the invention is:

1. An electronic ballast for supplying power to a gas discharge lamp having a filament to facilitate starting the lamp, said ballast comprising:

a source of high frequency pulses;

a series resonant, direct coupled output circuit including an inductor and a capacitor connected in series and coupled to said source, whereby said source produces a current through said inductor and said capacitor;

a filament winding magnetically coupled to said inductor and adapted to be coupled to said filament, whereby the current through said inductor produces an induced current in said filament winding;

wherein the induced current in the filament winding opposes a portion of the current from said inductor, thereby reducing the average voltage on said filament.

2. The ballast as set forth in claim 1 wherein said filament winding is coupled to the junction of said inductor and said capacitor.

3. The ballast as set forth in claim 2 wherein said filament winding and said inductor have a common lead.

4. The ballast as set forth in claim 1 wherein the current from said inductor includes a resonant component and a lamp component and said induced current opposes said resonant component.

5. The ballast as set forth in claim 1 for supplying power to a pair of discharge lamps, said pair including at least three filaments for facilitating starting and wherein said ballast further include:

a second filament winding magnetically coupled to said inductor and adapted to be coupled to a second of the filaments, a third filament winding magnetically coupled to said inductor and adapted to be coupled to a third of the filaments, wherein the current induced in each winding opposes a portion of the current from said inductor.

6. An electronic ballast for supplying power to a gas discharge lamp having a filament to facilitate starting the lamp, said ballast comprising:

a source of high frequency pulses;

a series resonant, direct coupled output circuit including an inductor and a capacitor connected in series and coupled to said source, whereby said source produces a current through said inductor and said capacitor;

a filament winding magnetically coupled to said inductor and adapted to form a closed circuit with said filament, wherein a first current component flows in a first direction in said closed circuit and a second current component flows in a second direction, opposite to the first direction, in said closed circuit;

wherein the current induced in the filament winding by said inductor is the first current component and a portion of the current through the inductor is the second current component.

* * * * *